US010948188B2

(12) United States Patent
Di Norscia et al.

(10) Patent No.: US 10,948,188 B2
(45) Date of Patent: Mar. 16, 2021

(54) FUEL INJECTOR WITH PERFORATED PLATE

(71) Applicant: Solar Turbines Incorporated, San Diego, CA (US)

(72) Inventors: Christian Di Norscia, San Diego, CA (US); Edouard Bahous, San Diego, CA (US); Michael J. Ramotowski, San Diego, CA (US); Ram Srinivasan, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 166 days.

(21) Appl. No.: 16/217,997

(22) Filed: Dec. 12, 2018

(65) Prior Publication Data

US 2020/0191395 A1 Jun. 18, 2020

(51) Int. Cl.

| | |
|---|---|
| ***F23R 3/28*** | (2006.01) |
| ***F23R 3/16*** | (2006.01) |
| ***F23R 3/34*** | (2006.01) |
| *F23R 3/14* | (2006.01) |

(52) U.S. Cl.

CPC ..... *F23R 3/16* (2013.01); *F23R 3/286* (2013.01); *F23R 3/343* (2013.01); *F23R 3/14* (2013.01); *F23R 2900/00014* (2013.01)

(58) Field of Classification Search

CPC .... F23R 3/14; F23R 3/16; F23R 3/283; F23R 3/286; F23R 2900/00014

See application file for complete search history.

(56) References Cited

U.S. PATENT DOCUMENTS

| | | | |
|---|---|---|---|
| 5,826,423 | A | 10/1998 | Lockyer et al. |
| 6,976,642 | B2 | 12/2005 | Albrodt et al. |
| 8,438,830 | B2 | 5/2013 | Lawson et al. |
| 8,671,691 | B2 | 3/2014 | Boardman et al. |
| 8,683,804 | B2 | 4/2014 | Boardman et al. |

(Continued)

FOREIGN PATENT DOCUMENTS

| | | |
|---|---|---|
| CN | 204943567 | 1/2016 |
| CN | 104791846 B | 5/2017 |

(Continued)

*Primary Examiner* — William H Rodriguez
(74) *Attorney, Agent, or Firm* — Procopio, Cory, Hargreaves & Savitch LLP

(57) ABSTRACT

A fuel injector for a combustor of a gas turbine engine is disclosed herein. The fuel injector includes a fuel delivery system for receiving and distributing fuel and an injector body. The injector body includes a primary fuel gallery, a pilot fuel gallery, a primary perforated plate, and a pilot distributor plate. The primary fuel gallery is formed as an annular cavity in the injector body and extends around an assembly axis. The primary fuel gallery and the pilot fuel gallery are in flow communication with the fuel delivery system. The primary perforated plate is disposed within the primary fuel gallery and divides the primary fuel gallery. The primary perforated plate having a first perforation to restrict flow. The pilot distributor plate is disposed within the center body assembly and radially inward of the first portion of the primary gallery, adjacent to portions of the tube stem. The pilot distributor plate having a pilot distributor passage to restrict flow.

18 Claims, 5 Drawing Sheets

(56) References Cited

U.S. PATENT DOCUMENTS

| | | | | |
|---|---|---|---|---|
| 8,966,908 | B2 | 3/2015 | Twardochleb et al. | |
| 9,353,950 | B2 * | 5/2016 | Uhm | F23R 3/286 |
| 2001/0052229 | A1 | 12/2001 | Tuthill et al. | |
| 2010/0162711 | A1 | 7/2010 | Zuo et al. | |
| 2013/0318977 | A1 * | 12/2013 | Berry | F23R 3/286 60/739 |
| 2014/0000274 | A1 | 1/2014 | Srinivasan | |
| 2014/0331676 | A1 * | 11/2014 | Cramb | F23D 11/402 60/740 |
| 2014/0331677 | A1 * | 11/2014 | Cramb | F02C 7/232 60/740 |
| 2014/0332602 | A1 * | 11/2014 | Cramb | B01F 5/06 239/104 |
| 2014/0332603 | A1 * | 11/2014 | Cramb | F23R 3/283 239/104 |
| 2015/0082797 | A1 | 3/2015 | Matsuyama et al. | |
| 2016/0076766 | A1 | 3/2016 | Jayatunga | |
| 2016/0178206 | A1 * | 6/2016 | Yoshino | F23R 3/10 60/738 |
| 2017/0191421 | A1 * | 7/2017 | Spivey | F23R 3/286 |
| 2017/0191428 | A1 * | 7/2017 | Spivey | F02C 7/22 |
| 2017/0191457 | A1 * | 7/2017 | Spivey | F02M 61/163 |
| 2017/0191667 | A1 * | 7/2017 | Spivey | F23R 3/343 |
| 2017/0298875 | A1 * | 10/2017 | Patel | F23R 3/14 |
| 2017/0298884 | A1 * | 10/2017 | Patel | F02M 43/04 |
| 2017/0299190 | A1 * | 10/2017 | Patel | F23R 3/36 |
| 2018/0142893 | A1 * | 5/2018 | Kumagai | F23R 3/286 |
| 2018/0163967 | A1 | 6/2018 | Arellano et al. | |
| 2018/0209647 | A1 * | 7/2018 | Bailey | F02C 7/232 |
| 2020/0011533 | A1 * | 1/2020 | Ramotowski | F02C 7/222 |

FOREIGN PATENT DOCUMENTS

| | | | |
|---|---|---|---|
| JP | 06239247 | A | 8/1994 |
| JP | 2001289441 | A | 10/2001 |
| KR | 10-2016-0139403 | A | 12/2016 |
| KR | 10-2018-0100623 | A | 9/2018 |

* cited by examiner

FUEL INJECTOR WITH PERFORATED PLATE

TECHNICAL FIELD

The present disclosure generally pertains to an injector head, and is directed toward a fuel injector with perforated plate.

BACKGROUND

Gas turbine engines include compressor, combustor, and turbine sections. During operation of the gas turbine engine combustion oscillations may damage or reduce the operating life of the components of the combustor. Combustion oscillations may be the result of resonance of the fuel and/or air flows in the fuel injectors with heat release process due to chemical reactions U.S. Pat. No. 8,966,908 to Twardochleb, et al. describes a fuel injector for a turbine engine that may include a body member disposed about a longitudinal axis, and a barrel member located radially outwardly from the body member. The fuel injector may also include an annular passageway extending between the body member and the barrel member from a first end to a second end. The first end may be configured to be fluidly coupled to a compressor of the turbine engine and/or the fuel delivery system, and the second end may be configured to be fluidly coupled to a combustor of the turbine engine. The fuel injector may also include a perforated plate positioned proximate the first end of the passageway. The perforated plate may be configured to direct compressed air into the annular passageway with a first pressure drop. The fuel injector may also include at least one fuel discharge orifice positioned downstream of the perforated plate. At least one fuel discharge orifice may be configured to discharge a fuel into the annular passageway with a second pressure drop. The second pressure drop may have a value between about the first pressure drop and about 1.75 times the first pressure drop.

The present disclosure is directed toward overcoming one or more of the problems discovered by the inventors or that is known in the art.

SUMMARY OF THE DISCLOSURE

A fuel injector for a gas turbine engine is disclosed herein. In embodiments the fuel injector includes a fuel delivery system for receiving and distributing fuel and an injector body. The injector body includes a primary fuel gallery and a primary perforated plate. The primary fuel gallery is formed as an annular cavity in the injector body and extends around an assembly axis. The primary fuel gallery is in flow communication with the fuel delivery system. The primary perforated plate is disposed within the primary fuel gallery and divides the primary fuel gallery. The primary perforated plate having a first perforation to restrict flow.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
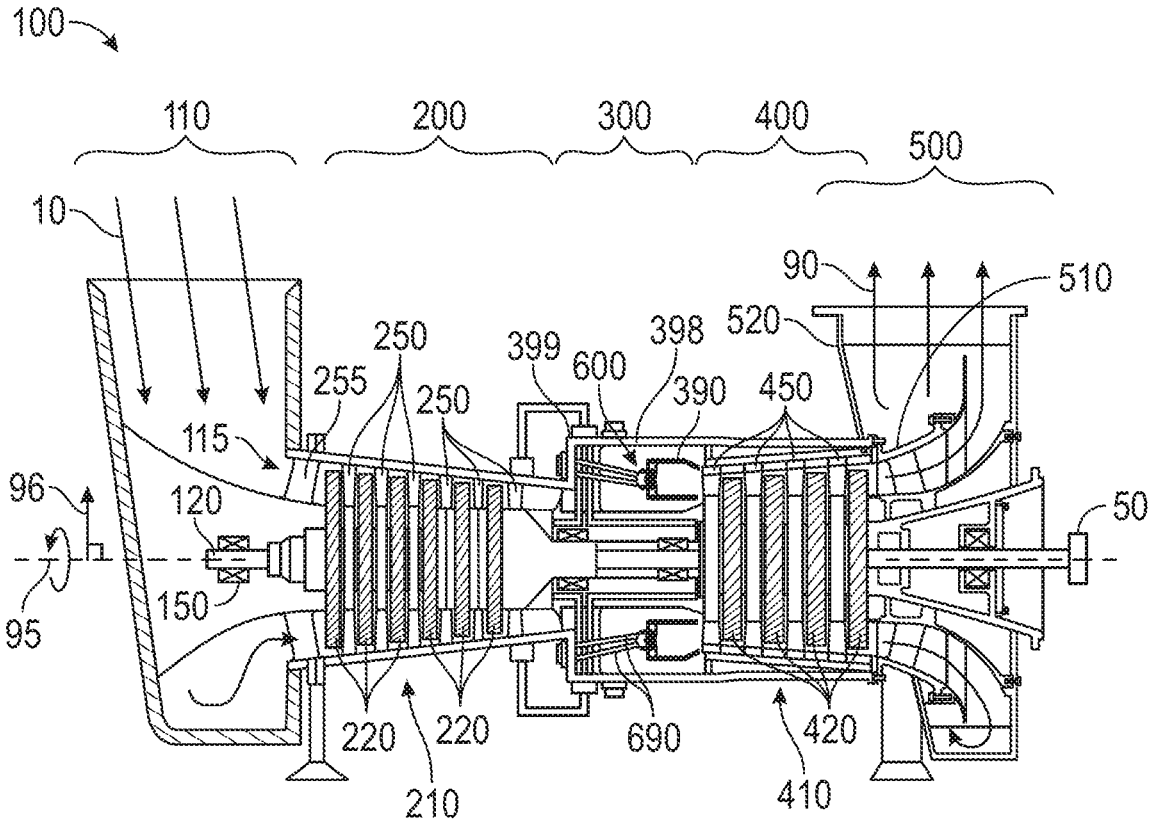
FIG. 1 is a schematic illustration of an exemplary gas turbine engine.

FIG. 1 is a schematic illustration of an exemplary gas turbine engine. Some of the surfaces and reference characters may have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine 100, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

Structurally, a gas turbine engine 100 includes an inlet 110, a compressor 200, a combustor 300, a turbine 400, an exhaust 500, and a power output coupling 50. The compressor 200 includes one or more compressor rotor assemblies 220. The combustor 300 includes one or more fuel injectors 600 and includes one or more combustion chambers 390. The turbine 400 includes one or more turbine rotor assemblies 420. The exhaust 500 includes an exhaust diffuser 510 and an exhaust collector 520.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes ("stator vanes" or "stators") 250, 450 circumferentially distributed in an annular casing.

Functionally, a gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly is the forward most of the turbine rotor assemblies 420. However, other numbering/naming conventions may also be used.

Once compressed air 10 leaves the compressor 200, it enters the combustor 300, where it is diffused and fuel is added. Air 10 and fuel are injected into the combustion chamber 390 via fuel injector 600 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 510 and collected, redirected, and exit the system via an exhaust collector 520. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
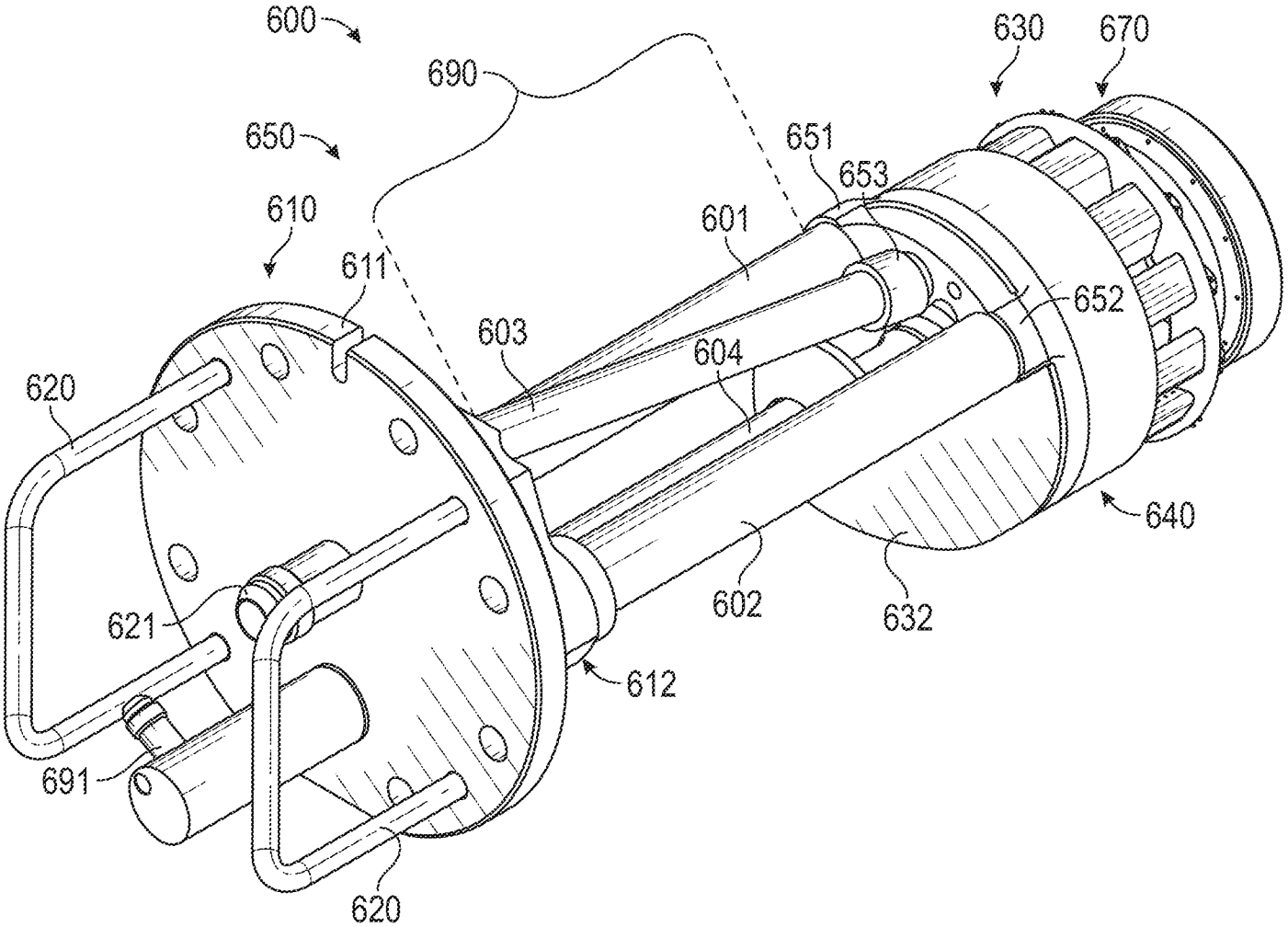
FIG. 2 is a perspective view of an embodiment of the fuel injector.

FIG. 2 is a perspective view of the fuel injector 600 of FIG. 1. Referring to FIG. 2, the flange assembly 610 may include a flange 611, a distribution block 612, fittings, and handles 620. A single fitting may be used for each fuel circuit. The flange 611 may be a cylindrical disk and may include holes for fastening the fuel injector 600 to the combustor case 398.

The distribution block 612 extends from the flange 611 and may extend in the axial direction of the flange 611. The flange 611 and the distribution block 612 may be formed as an integral piece. The distribution block 612 may act as a manifold for one or more of the fuel circuits to distribute the fuel flow of one or more of the circuits through multiple fuel tubes 690 or passages.

The fuel tubes 690 may include a first primary tube 601, a second primary tube 602, a secondary tube 603, and a tube stem 604. The first primary tube 601 and the second primary tube 602 may be part of a primary main fuel circuit. The first primary tube 601 and the second primary tube 602 may be parallel and may extend parallel to the assembly axis 797.

The secondary tube 603 may be part of the primary main fuel circuit or may be part of a secondary main fuel circuit. The secondary tube 603 may extend from the distribution block 612 to the injector head 630 at an angle relative to the first primary tube 601 and the second primary tube 602, and may act as a support tube for an injector head 630 to prevent deflection of the injector head 630.

The injector head 630 may include an injector body 640, an outer cap 632, and an outer premix barrel 670. The injector body 640 may include a first primary fuel transfer fitting 651, a second primary fuel transfer fitting 652, and a secondary fuel transfer fitting 653. The first primary tube 601 may connect to the injector head 630 at the first primary fuel transfer fitting 651. The second primary tube 602 may connect to the injector head 630 at the second primary fuel transfer fitting 652, and the secondary tube 603 may connect to the injector head 630 at the secondary fuel transfer fitting 653.

The outer cap 632 may connect to the injector body 640 and may be located between the injector body 640 and the flange assembly 610. The outer cap 632 may include openings that allow compressor discharge air to enter into the injector head 630.

The flange assembly 610, the fuel tubes 690, the injector body 640, and the outer premix barrel 670 include or may be assembled to form passages for the main fuel circuit(s) and the pilot fuel circuit. Embodiments of these fuel circuits are disclosed herein and will be discussed in association with the remaining figures.

The flange assembly 610 and the fuel tubes 690 can make up a fuel delivery system 650 for receiving a main fuel and a pilot fuel and distributing the main fuel and pilot fuel to the injector head 630.

Figure 3:
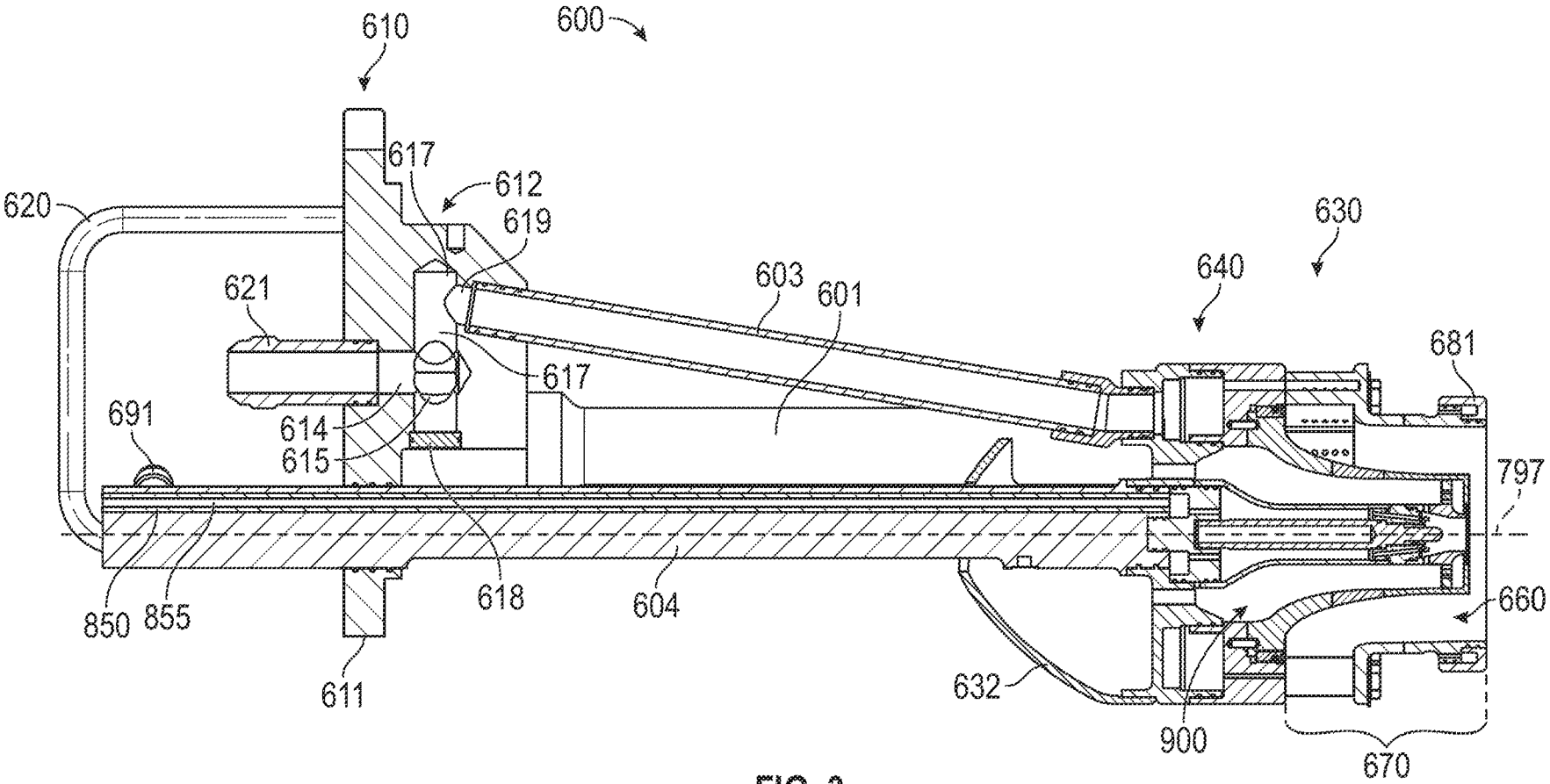
FIG. 3 is a cross-sectional view of an embodiment of the injector head of FIG. 2.

FIG. 3 is a cross-sectional view of an embodiment of the fuel injector 600 of FIG. 2. The injector head 630 may include an assembly axis 797. All references to radial, axial, and circumferential directions and measures of the injector head 630 and the elements of the injector head 630 refer to the assembly axis 797, and terms such as "inner" and "outer" generally indicate a lesser or greater radial distance from the assembly axis 797. The center of the flange 611 may be offset from the assembly axis 797. In an embodiment in FIG. 3, the first primary tube 601, the second primary tube 602, and the secondary tube 603 form a single primary main fuel circuit.

The flange assembly 610 may include a primary fuel fitting 621 affixed to the flange 611 and a fuel inlet passage 614 in flow communication with the primary fuel fitting 621. The fuel inlet passage 614 may extend through the flange 611 and into the distribution block 612. The distribution block 612 includes a first primary passage 615 and a secondary passage 617 and may include a second primary passage. In an embodiment, the first primary passage 615, and the secondary passage 617 are all in flow communication with the fuel inlet passage 614. The first primary passage 615, the second primary passage, and the secondary passage 617 may connect to the fuel inlet passage 614, and may be in a parallel flow configuration.

The flange assembly 610 may also include a secondary tube port 619. The first primary tube 601 may connect to the distribution block 612 and may be in flow communication with the first primary passage 615. The second primary tube 602 may connect to the distribution block 612 and may be in flow communication with the second primary passage. The secondary tube 603 may connect to the distribution block 612 at the secondary tube port 619, may be in flow communication with the secondary passage 617, and may fluidly connect the secondary passage 617 to the secondary tube 603.

The first primary passage 615, the second primary passage, and the secondary passage 617 may all intersect the fuel inlet passage 614 at the same location. In an embodiment, the first primary passage 615, the second primary passage, and the secondary passage 617 are cross-drilled. The first primary passage 615 can be drilled at an angle from the side of the distribution block 612 and intersect with the fuel inlet passage 614. The second primary passage can be drilled at an angle from the opposite side of the distribution block 612 and intersect with the fuel inlet passage 614 and the first primary passage 615. The secondary passage 617 can be drilled up from the bottom of the distribution block 612, intersect with the fuel inlet passage 614, the first primary passage 615 and the second primary passage, and extend to the secondary tube port 619. The flange assembly 610 may include a plug 618 at the end of each passage distal to its respective tube port.

In some embodiments, the first primary passage 615, the second primary passage, and the secondary passage 617 may all start at the fuel inlet passage 614 and extend to their respective tube ports. For example, the first primary passage 615, the second primary passage, and the secondary passage 617 may be formed concurrently with the distribution block 612 during an additive manufacturing process and may not require cross-drilling.

In an embodiment, the distribution block 612 is shaped to extend around the tube stem 604. The fuel injector 600 may also include a pilot fuel fitting 691 connected to the tube stem 604 distal to the injector head 630 and configured to receive a fuel source.

The tube stem 604 may extend through the flange assembly 610 and into the injector head 630. The tube stem 604 may include a pilot fuel tube 850 for a pilot fuel circuit. The pilot fuel tube 850 is disposed within the tube stem 604 and can extend from proximate the forward end of the tube stem 604 to the injector head 630. The pilot fuel tube 850 may be shaped as a hollow cylinder. The pilot fuel tube 850 may include a pilot fuel passage 855. The pilot fuel passage 855 can be the hollow space formed by the pilot fuel tube 850. The pilot fuel passage 855 can be in flow communication with the pilot fuel fitting 691 and be part of the pilot fuel circuit.

Figure 4:
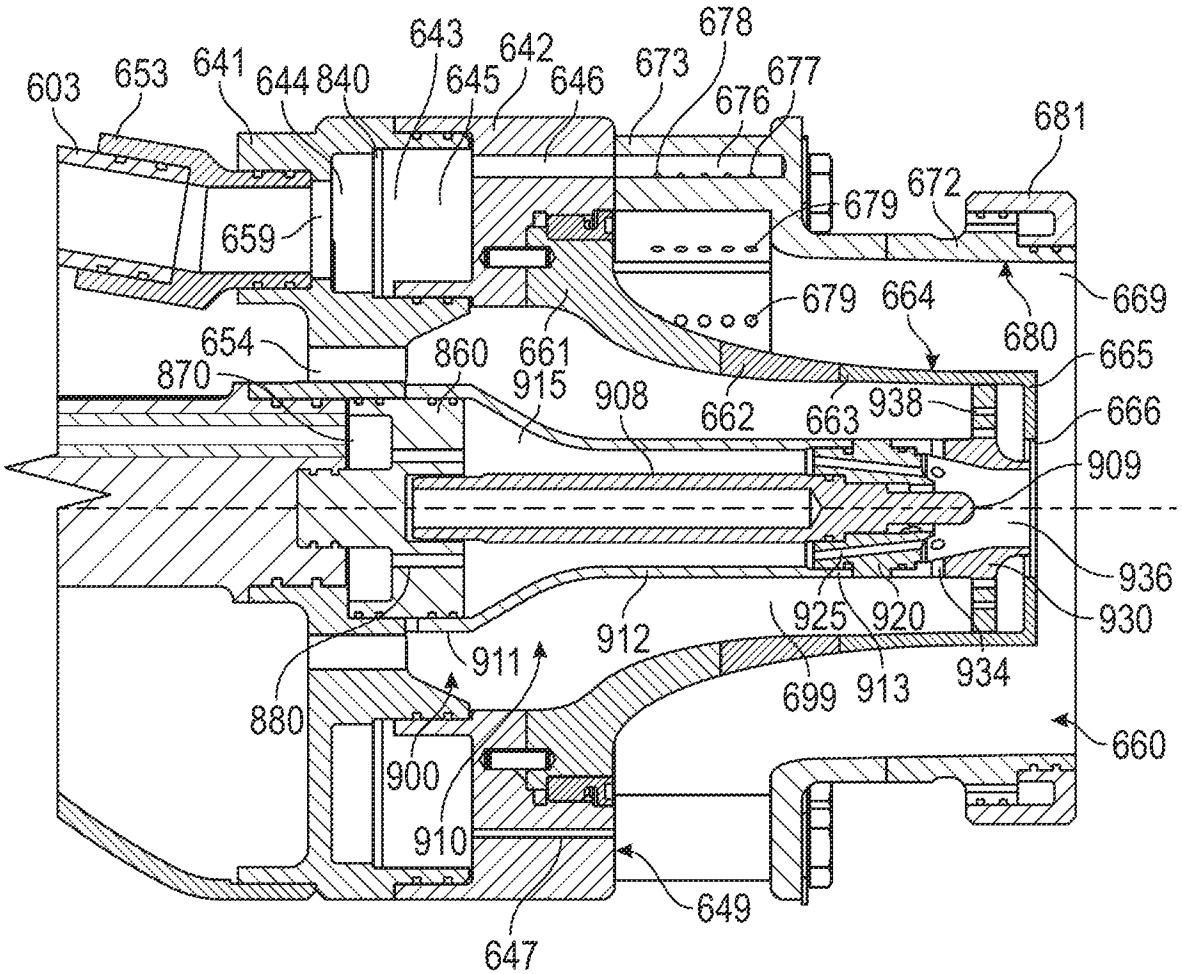
FIG. 4 is a portion of a cross-sectional view of an embodiment of the injector head of FIG. 2.

FIG. 4 is a portion of a cross-sectional view of an embodiment of the fuel injector 600 of FIG. 2. The injector body 640 may include a first portion 641 and a second portion 642. The first portion 641 can partially be disposed adjacent to the tube stem 604 and outer cap 632, extending outward from the tube stem 604 to the outer cap 632. The first portion 641 may have a cylindrical shape and may have multiple voids and cavities. The first portion 641 may have a portion shaped as a hollow cylinder with a 'C', 'U', or 'J' shaped cross-section revolved about assembly axis 797 creating a first portion hollow cavity 644. The first portion 641 may define a first end of the primary fuel gallery 643. The first portion 641 may be partially disposed between the primary perforated plate 840 and the fuel delivery system 650 and upstream of the primary fuel gallery 643. A feed air passage 654 may extend through the base of the first portion 641 in the axial direction. The feed air passage 654 may be located radially outward from the assembly axis 797 and the tube stem 604 and may be located radially inward from the second portion 642 with respect to the assembly axis 797.

The second portion 642 may have a cylindrical shaped base and may be a hollow cylinder. The second portion 642 can be disposed adjacent the first portion, extending in the forward direction. The second portion 642 may have a portion shaped as a hollow cylinder with a 'C', 'U', or 'J' shaped cross-section revolved about assembly axis 797 creating a second portion hollow cavity 645. The second portion 642 defining a second end of the primary fuel gallery 643, opposite the first portion 641, and partially disposed downstream of the primary fuel gallery 643 and in flow communication with the primary fuel gallery 643. The second portion 642 may also include an injector body face 649. The injector body face 649 may be an annulus and may face in the aft axial direction, opposite the first portion 641. The second portion 642 and first portion 641 may be metallurgically bonded, such as by brazing or welding.

The first primary fuel transfer fitting 651, the second primary fuel transfer fitting 652, and the secondary fuel transfer fitting 653 may be integral to the first portion 641 and may be located on the opposite axial side of the first portion 641 relative to the second portion 642.

The injector head 630 also includes a primary fuel gallery 643, primary gallery inlets, a secondary gallery inlet 659, a body primary fuel passage 646, a second primary fuel passage 647, and a primary perforated plate 840. The first portion 641 and the second portion 642 may be joined together to form the primary fuel gallery 643. In other words, the primary fuel gallery 643 comprises the first portion hollow cavity 644 and the second portion hollow cavity 645. Alternatively, the first portion 641 and the second portion 642 can be two parts of a single piece. The primary fuel gallery 643 may be an annular cavity extending around the assembly axis 797. In embodiments, the 'C', 'U', or 'J' cross-sectional shape of the first portion 641 revolved about assembly axis 797 may form the primary fuel gallery 643 when affixed to the second portion 642.

The injector head 630 may include a primary gallery inlet adjacent each primary fuel transfer fitting, such as the first primary fuel transfer fitting 651 and the second primary fuel transfer fitting 652. The primary gallery inlet may be an opening extending through an aft end of the first portion 641 that extends to the primary fuel gallery 643 so that the primary fuel tube connected to the adjacent primary fuel transfer fitting 651 is in flow communication with the primary fuel gallery 643. In an embodiment, the secondary gallery inlet 659 is an opening extending through a forward end of the first portion 641 that extends to the primary fuel gallery 643 so that the secondary tube 603 is in flow communication with the primary fuel gallery 643.

The body primary fuel passages 646 and the second primary fuel passages 647 may extend axially through the second portion 642 from the primary fuel gallery 643 to provide a path for the primary fuel to the vane primary fuel passage 676 and for the primary fuel to the injector body face 649. In an embodiment, the main fuel is provided to the vane primary fuel passage 676 and the injector body face 649 within the main fuel circuit. The main fuel circuit includes the primary fuel fitting 621, the fuel inlet passage 614, the first primary passage 615, the second primary passage, the secondary passage 617, the first primary tube 601, the second primary tube 602, the secondary tube 603, the primary fuel gallery 643, and the body primary fuel passage 646 and the second primary fuel passage 647.

The injector head 630 may also include a head stem cavity and a center body opening. The head stem cavity may extend through the first portion 641 and may be the hollow portion of the hollow cylinder shape of the first portion 641. The center body opening may be coaxial to the second portion 642 and may extend through the base of the second portion 642 in the axial direction. The feed air passage 654 may extend through the base of the first portion 641 in the axial direction. The feed air passage 654 may be located radially outward from the assembly axis 797, the tube stem 604, and the center body opening, and may be located radially inward from the second portion 642 with respect to the assembly axis 797.

The outer cap 632 may be a dome shaped cap that attaches to the injector body 640 at the radially outer surface of the first portion 641. The outer cap 632 may include multiple holes and passageways for one or more of the fuel tubes 690 and for compressor discharge air to enter the fuel injector 600.

The injector head 630 may also include the primary perforated plate 840. The primary perforated plate 840 is disposed within the primary fuel gallery 643 and can divide the primary fuel gallery 643. The primary perforated plate 840 is disposed radially outward of the feed air passage 654 and the tube stem 604, with respect to the assembly axis 797.

The primary perforated plate 840 may be disposed between the first portion 641 and the second portion 642. In other words, the primary perforated plate 840 may be disposed between the body primary fuel passage 646, the second primary fuel passage 647 and the outer cap 632. The primary perforated plate 840 may be disposed between the secondary gallery inlet 659 and the second portion 642. The primary perforated plate 840 may extend radially outward across the hollow cavity of the first portion 641. The primary perforated plate 840 may have a rectangular cross-section rotated around the assembly axis 797 and be shaped as an annular plate.

The outer premix barrel 670 is joined to the injector body 640 and located radially outward from the inner premix tube 660. The outer premix barrel 670 may include a vane portion 673, a barrel end 672, and a premix tube outer surface 680. The vane portion 673 may be disposed radially outward from a portion of the center body assembly 900 with respect to the assembly axis 797. The vane portion 673 extend from adjacent the injector body face 649 and towards the forward direction. The vane portion 673 may have a portion that is wedge shaped and may have the tip of the wedge truncated or removed. The vane portion 673 may have a portion this is shaped like a hollow cylinder. The vane portion 673 may have a portion shaped as an annulus. The vane portion 673 may include other shapes configured to direct air into a premix passage 669.

The vane portion 673 may include a vane primary fuel passage 676, a primary fuel outlet 677, and a vent air outlet 679. The vane primary fuel passage 676 may extend axially into each vane portion 673. Each vane primary fuel passage 676 is aligned with and in flow communication with a body primary fuel passage 646. The primary fuel outlet 677 extends from the vane primary fuel passage 676 and through the vane portion 673. In an embodiment, the primary fuel outlet 677 extends transverse to the vane primary fuel passage 676 so that the primary fuel will exit from the primary fuel outlet 677 between adjacent vane portions 673 in a tangential direction relative to the assembly axis 797 and into the premix passage 669. In an embodiment, the vane primary fuel passage 676 and the primary fuel outlet 677 are part of the primary main fuel circuit.

A vent air passage may also extend axially into each vane portion 673 and may be located proximate the vane primary fuel passage 676. The vent air outlet 679 extends from the vent air passages through vane portion 673 and may exit the vane portion 673 at the narrow end of the wedge shape to prevent lower pressure pockets from forming at the end of the vane portion 673.

The barrel end 672 may be metallurgically joined to the aft end of the vane portion 673, such as by welding or brazing. The barrel end 672 may have a hollow cylinder or cylindrical tube shape. The premix barrel cap 681 may be metallurgically joined, such as by welding or brazing, to the aft end of the barrel end 672 at the outer surface of the barrel end 672. The premix barrel cap 681 may have a 'C', 'U', or 'J' shaped cross-section that is revolved about assembly axis 797. The premix barrel cap 681 may form an air pocket or channel with the barrel end 672.

The premix tube outer surface 680 may include the radially inner cylindrical surfaces of the outer premix barrel 670. When installed in the injector head 630, the premix tube outer surface 680 may be located radially outward from the inner premix tube 660.

The inner premix tube 660 may be joined to the injector body 640 and may include a transition end 661, a middle tube 662, a tip end 663, a tip face 665, and a premix tube inner surface 664. In an embodiment the transition end 661 is a hyperbolic funnel that initiates a transition from the radial direction to the axial direction relative to the assembly axis 797.

The middle tube 662 may be metallurgically joined to the aft end of the transition end 661, such as by welding or brazing. In the embodiment shown, the middle tube 662 continues the hyperbolic funnel shape of the transition end 661. In other embodiments, middle tube 662 may be a conical frustum, a funnel, or formed from a cross-section with curved outer and inner surfaces revolved about the axis of inner premix tube 660.

The tip end 663 may be metallurgically joined to the aft end of the middle tube 662 distal to the transition end 661. The tip face 665 extends radially inward from the tip end 663 and may be integral to the tip end 663. Tip end 663 may have an annular disk shape which forms a tip opening 666.

The premix tube inner surface 664 is at least a portion of the outer surface of the inner premix tube 660. The premix tube inner surface 664 may be a revolved surface about the axis of the inner premix tube 660 that transitions from a radial or an annular ring surface to a circumferential or cylindrical surface In other embodiments, the radial surface may transition to a cylindrical surface with a combination of line segments or curves revolved about the axis of inner premix tube 660.

The premix tube inner surface 664 is spaced apart from the premix tube outer surface 680 forming a premix passage 669 there between. The premix passage 669 may be an annular passage. Compressor discharge air 10 may enter the premix passage 669 between the vane portions 673 and may mix with the fuel exiting the primary fuel outlets 677 and the second primary fuel passage outlets 822. The premix passage 669 may direct the fuel air mixture into the combustion chamber 390 for combustion.

The center body assembly 900 may be located radially inward of the inner premix tube 660 and of the injector body 640. The center body assembly 900 may be axially adjacent to the first portion 641 and may be metallurgically bonded, such as by brazing or welding, to the first portion 641.

The center body assembly 900 may include a center body 910, a pilot tube 908, a pilot block 920, and a center body tip portion 930.

The center body 910 is located radially inward of the second portion 642 and is disposed between the tube stem 604 and tip opening 666. In other words, the center body 910 is located downstream of the tube stem 604. The center body 910 may include a center body base end 911, a center body middle portion 912, and a center body tip end 913. The center body base end 911 may be disposed adjacent the first portion 641. The center body base end 911 may include a cylindrical shape and may be flanged relative to the center body middle portion 912. The center body middle portion 912 extends between the center body base end 911 and the center body tip end 913 and may be a cylindrical shape such as a hollow cylinder. The center body tip end 913 is distal to the center body base end 911 and may be adjacent the pilot block 920. The center body tip end 913 can be shaped to accept the pilot block 920. The hollow space within the center body 910 can define the outward limits of a center body pilot fuel passage 915. The center body pilot fuel passage 915 can be in flow communication with the pilot distributor passage 880 and part of the pilot fuel circuit.

The pilot block 920 may be located adjacent the center body tip end 913. The pilot block 920 may extend from the center body tip end 913 and can be located radially inward from the air pathway 699, inner premix tube 660, and outer premix barrel 670. The pilot block 920 may have a pilot block pilot fuel passage 925. The pilot block pilot fuel passage 925 can be in flow communication with and extend from the center body pilot fuel passage 915 towards the tip opening 666.

The center body tip portion 930 can be disposed adjacent the pilot block 920 and extend from the pilot block 920 towards the tip opening 666. In other words, the center body tip portion 930 can extend from the pilot block 920 towards the forward direction. The center body tip portion 930 can be disposed adjacent to the tip face 665 and radially inward of the tip face 665 with respect to the assembly axis 797. The center body tip portion 930 may have a hollow cylindrical shape with an outer flange portion shaped as a perforated annulus. The center body tip portion 930 may have a pilot premix passage 936 that is formed by the hollow cylindrical shape of the center body tip portion 930 and is in flow communication with the pilot block pilot fuel passage 925.

The center body tip portion 930 may include a tip air passage 934 and an air pathway passage 938. The tip air passage 934 may be in flow communication with the air pathway 699 and may extend from the air pathway 699 to the pilot premix passage 936. The air pathway passage 938 may be in flow communication with the air pathway 699 and may extend from the air pathway 699 to the aft end of the fuel injector 600.

Portions of the pilot tube 908 are located radially inward of the center body 910, the pilot block 920, and the center body tip portion 930 with respect to the assembly axis 797. A first portion of pilot tube 908 is disposed proximate to the tube stem 604 and the first portion 641. The pilot tube 908 may partially be radially inward of a second portion 642 with respect to the assembly axis 797. A portion of the pilot tube 908 can extend through the pilot block 920. The pilot tube 908 may have a pilot tip 909 that is disposed between the pilot block 920 and the tip opening 666. The pilot tip 909 may extend from the pilot block 920 towards the tip opening 666.

The center body assembly 900 may also include a pilot distributor 860. The pilot distributor 860 can be disposed radially inward of the first portion 641 with respect to the assembly axis 797, and be adjacent to portions the tube stem 604, first portion 641, and the center body 910. A pilot fuel gallery 870 may be a space formed by the pilot distributor 860, the tube stem 604, and the first portion 641. The pilot fuel gallery 870 may be in flow communication with the pilot fuel passage 855. The pilot fuel gallery 870 may be a space shaped as an annular plate located around the assembly axis 797. The pilot distributor 860 may include a pilot distributor passage 880. The pilot distributor passage 880 can be in flow communication with the pilot fuel gallery 870 and can extend through the pilot distributor 860 from the pilot fuel gallery 870 to the center body pilot fuel passage 915. The pilot distributor passage 880 may have a circular cross-section and shaped as a cylinder. The sizing, spacing, shape, and density of the pilot distributor passages 880 may be selected for dampening the oscillation response of the combustor 300.

Figure 5:
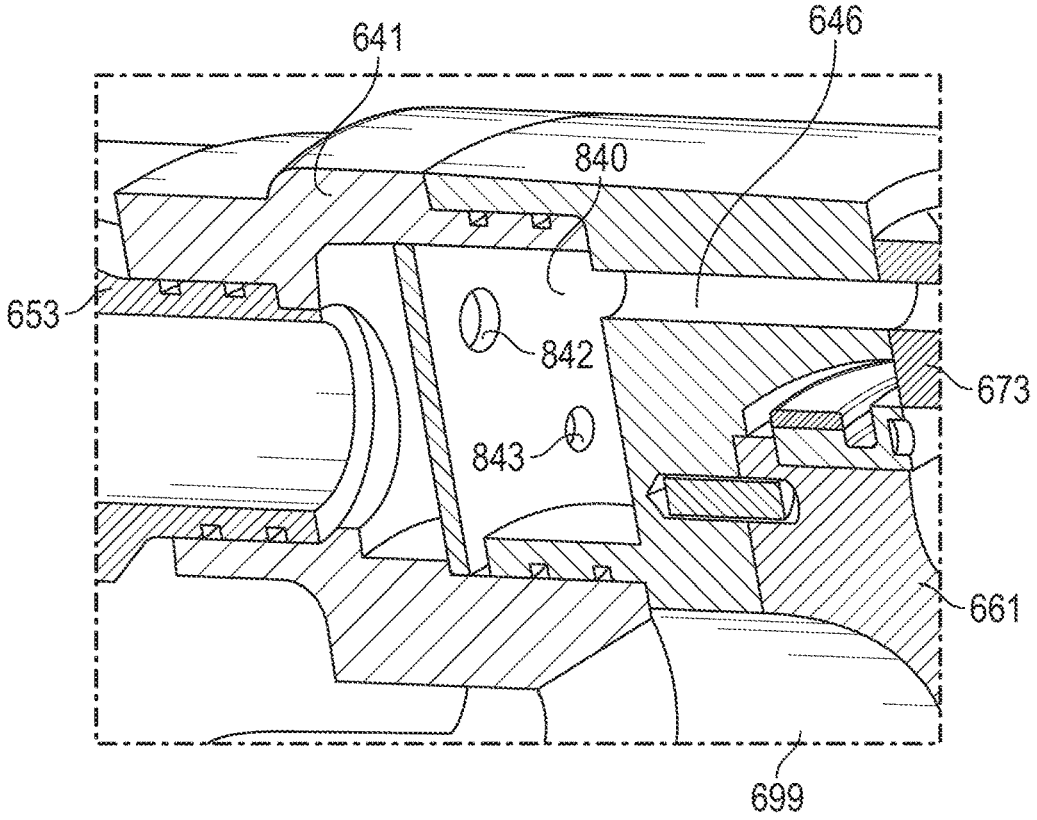
FIG. 5 is a cross-sectional perspective view of a portion of the injector head of FIG. 2.

FIG. 5 is perspective cross sectional view of the fuel injector from FIG. 2. In an embodiment the primary perforated plate 840 is disposed within the first portion 641, downstream of the secondary fuel transfer fitting 653, and upstream of the second portion 642. The primary perforated plate 840 may have multiple perforations of varying size, shape, and quantity. In an embodiment, the primary perforated plate 840 includes a first perforation 842 and a second perforation 843. The first perforation 842 and second perforation 843 are circular shaped and have varying sizes. In another embodiment the first perforation 842 and the second perforation 843 can be the same size. In an embodiment the first perforation 842 can be sized larger than the second perforation 843. In an embodiment, there can be multiple first perforations 842 and second perforations 843. The first perforation 842 and the second perforation 843 can have varying shapes including elliptical, rectangular, triangular, irregular shapes, multi-sided shapes, and other shapes of the like. The sizing, spacing, shape, and density of the first perforations 842 and the second perforations 843 may be selected for dampening the oscillation response of the combustor 300. The first perforation 842 and the second perforation 843 can determine the plate porosity and be configured to restrict gas and fluid flow.

Figure 6:
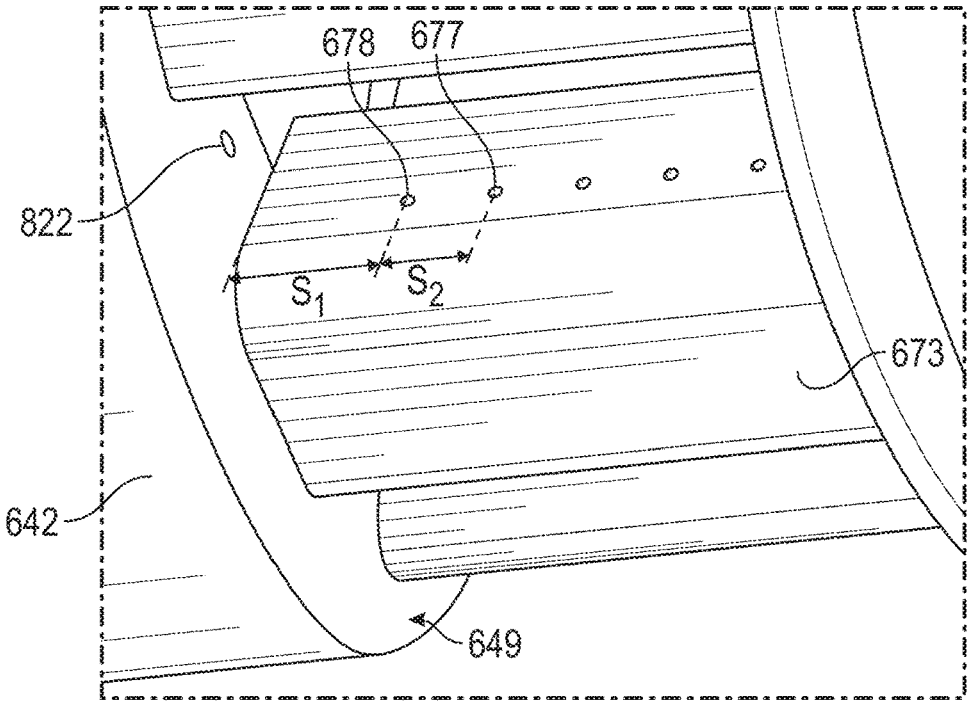
FIG. 6 is a cross-sectional perspective view of a portion of the injector head of FIG. 2.

FIG. 6 is perspective view of the fuel injector from FIG. 2. In an embodiment, the vane portion 673 is disposed adjacent the injector body face 649, downstream of the second portion 642. The vane portion 673 includes primary fuel outlets 677. The primary fuel outlets 677 may have a first primary fuel outlet 678 that is disposed closer to the injector body face 649 than the other primary fuel outlets 677. The first primary fuel outlet 678 is spaced from the injector body face 649 at a distance of a first primary fuel outlet space S1. The primary fuel outlets 677 are spaced apart from each other at a distance of a primary fuel outlet space S2. The first primary fuel outlet space S1 and the primary fuel outlet space S2 may be adjusted to change the oscillation response of the combustor 300. In an embodiment the primary fuel outlet space S2 may be less than the first primary fuel outlet space S1.

In an embodiment, the primary fuel outlets 677 are circular shaped and have the same size. In another embodiment the primary fuel outlets 677 can vary in size. The primary fuel outlets 677 can have varying shapes including elliptical, rectangular, triangular, irregular shapes, multi-sided shapes, and other shapes of the like. The sizing, spacing, shape, and density of the primary fuel outlets 677 may be selected for dampening the oscillation response of the combustor 300.

In an embodiment, the injector body face 649 has a second primary fuel passage outlet 822. The second primary fuel passage outlet 822 is in flow communication with the second primary fuel passage 647 and can be part of the main fuel circuit.

INDUSTRIAL APPLICABILITY

Gas turbine engines may be suited for any number of industrial applications such as various aspects of the oil and fuel industry (including transmission, gathering, storage, withdrawal, and lifting of oil and natural fuel), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction, going from the inlet 110 towards the exhaust 500). Likewise, each turbine rotor assembly 420 may be associated with a numbered stage.

Once compressed air 10 leaves the compressor 200, it enters the combustor 300, where it is diffused and fuel is added. Air 10 and fuel are injected into the combustion chamber 390 and combusted. An air and fuel mixture is supplied via fuel injector 600. Energy is extracted from the combustion reaction via the turbine 400 by each stage of the series of turbine rotor assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Resonance between the combustor heat release process ("flame") and passages in the fuel injector 600 may result in combustor dynamic pressure oscillations. These passages may include fuel passages, air passages, and fuel/air mixture passages, such as the passages described herein. The resonance mode and oscillation response of the fuel injector 600 and combustor 300 can be changed by changing the main flame to pilot flame interaction and increasing the impedance of the system. This can be achieved by adequately positioning and sizing the fuel supply outlets and by utilizing a pilot distributor 860 and primary perforated plate 840.

The damping functions of the primary perforated plate 840 and the pilot distributor 860 are optimized respectively for fuel galleries that feed the main primary and pilot fuel circuits. The primary perforated plate 840 can have the first perforation 842 and the second perforation 843 that can vary in size, spacing, shape, and density for dampening the oscillation response of the combustor 300. Similarly the pilot distributor 860 can have pilot distributor passages 880 that can vary in size, spacing, shape, and density for dampening the oscillation response of the combustor 300.

The primary fuel outlets 677 and second primary fuel passage outlets 822 can be elements that can be adjusted to tune the oscillation response of the combustor 300. The second primary fuel passage outlet 822 can be sized smaller or larger to change the oscillation response. The primary fuel outlets 677 can change the combustor oscillation by changing the spacing between the first primary fuel outlet 678 and the injector body face 649 and by the spacing between each primary fuel outlets 677.

The first perforation 842, the second perforation 843, the second primary fuel passage outlet 822, the first primary fuel outlet space S1, and the primary fuel outlet space S2, can be adjusted independently or can be adjusted together to enhance the dampening effect against combustor oscillations. One or more of the first perforation 842, the second perforation 843, the second primary fuel passage outlet 822, the first primary fuel outlet space S1, and the primary fuel outlet space S2, can be selected to be adjusted as pairs or as in groups to enhance the dampening effect against combustor oscillations.

Similar configurations can be used to enhance the dampening effect against combustor oscillations gas only fuel injectors, duel fuel injectors, and lead direct fuel injectors. Counteracting and reducing combustor oscillations may increase the durability and operating life of the combustor 300 and the various components of the combustor 300.

The preceding detailed description is merely exemplary in nature and is not intended to limit the invention or the application and uses of the invention. The described embodiments are not limited to use in conjunction with a particular type of gas turbine engine or a particular combustor 300. Hence, although the present disclosure, for convenience of explanation, depicts and describes particular embodiments of the fuel injector 600 for a combustor 300, it will be appreciated that the fuel injector in accordance with this disclosure can be implemented in various other configurations, can be used with various other types of combustors and gas turbine engines, and can be used in other types of machines. Further, the perforated and distributor plates may be used in conjunction with pilot or main passages for air, fuel, or a mixture thereof and can be used with passages for fuel or fuel. Any explanation in connection with one embodiment applies to similar features of other embodiments, and elements of multiple embodiments can be combined to form other embodiments. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A fuel injector for a gas turbine engine, comprising:

a fuel delivery system for receiving and distributing fuel;

an injector body having a primary fuel gallery formed as an annular cavity in the injector body that extends around an assembly axis, in flow communication with the fuel delivery system, a primary gallery inlet in flow communication with the fuel delivery system and the primary fuel gallery, a primary perforated plate disposed within the primary fuel gallery, dividing the primary fuel gallery, the primary perforated plate having a first perforation to restrict flow, a first portion defining a first end of the primary fuel gallery, partially disposed between the primary perforated plate and the fuel delivery system, and having a secondary gallery inlet in flow communication with and adjacent to the fuel delivery system, and a second portion defining a second end of the primary fuel gallery, opposite the first portion, and in flow communication with the primary fuel gallery and including an injector body face disposed at an aft end of the second portion, opposite the first portion, a body primary fuel passage extending through the second portion, a second primary fuel passage extending through the second portion, and a second primary fuel passage outlet disposed at the injector body face; and a vane portion adjacent the injector body face, the second primary fuel passage outlet is located between adjacent vane portions, and the vane portions including a vane primary fuel passage, aligned with the body primary fuel passage and extending into the vane portion, in flow communication with the body primary fuel passage, and primary fuel outlets extending from the vane primary fuel passage, each of primary fuel outlets extending through the vane portion.

2. The fuel injector of claim 1, wherein the first perforation is sized to dampen the oscillation response of the combustor.

3. The fuel injector of claim 1, wherein the primary perforated plate includes a second perforation that is smaller than the first perforation.

4. The fuel injector of claim 3, wherein the first perforation, the second perforation, the second primary fuel passage outlet, the first primary fuel outlet space, and the primary fuel outlet space, are adjusted together to enhance the dampening effect against the combustor oscillations.

5. The fuel injector of claim 1, wherein the primary fuel gallery is disposed between the fuel delivery system and the vane portion.

6. The fuel injector of claim 1, wherein the perforated plate is shaped as an annular disk disposed around the assembly axis.

7. A fuel injector for a gas turbine engine, comprising:

a fuel delivery system for receiving and distributing a main fuel and comprising a flange, a primary fuel fitting for receiving a main fuel, affixed to the flange, a distribution block extending from the flange, the distribution block defining a fuel inlet passage extending into the distribution block, the fuel inlet passage configured to receive the main fuel from the primary fuel fitting, a first primary tube extending from the distribution block, a secondary tube extending from the distribution block, configured to distribute the main fuel from the fuel inlet passage;

a primary fuel gallery for receiving the main fuel;

a primary perforated plate having a first perforation for restricting the flow of the main fuel within the primary fuel gallery and for reducing amplitude of combustor oscillations; and an injector body having a secondary fuel transfer fitting for receiving the main fuel and distributing the main fuel into the injector body, a first portion for receiving the main fuel from the secondary fuel transfer fitting, a second portion for adjoining the first portion and forming the primary fuel gallery, and having a second primary fuel passage for receiving the main fuel from the primary fuel gallery and distributing the main fuel through the second portion, and having a second primary fuel passage outlet for distributing the main fuel that is sized to change the combustor oscillation response mode, and a body primary fuel passage for receiving the main fuel from the primary fuel gallery and distributing the main fuel through the second portion, and a vane primary fuel passage, for receiving the main fuel from the body primary fuel passage, and having primary fuel outlets for receiving fuel from the vane primary passage and distributing the main fuel for premixing, having a distance between each of the primary fuel outlets sized to change the combustor oscillation mode and amplitude.

8. The fuel injector of claim 7, wherein the fuel delivery system a pilot fuel fitting for receiving a pilot fuel, a tube stem defining a pilot fuel tube defining a pilot fuel passage for receiving the pilot fuel from the pilot fuel fitting, and wherein the injector body includes a first portion for adjoining the injector body to the tube stem, a pilot distributor for restricting the flow of the pilot fuel and configured to change the combustor oscillation mode and amplitude a pilot fuel gallery formed by the first portion, the tube stem, and the pilot distributor, for receiving the pilot fuel from the pilot fuel tube and distributing the pilot fuel around an assembly axis, a pilot distributor passage for receiving pilot fuel from the pilot fuel gallery and distributing the pilot fuel through the pilot distributor, and a center body defining a center body pilot fuel passage for receiving the pilot fuel from the pilot distributor passage and distributing the pilot fuel through the center body, and a pilot block for adjoining to the center body and defining a pilot block pilot fuel passage for receiving the pilot fuel and distributing the pilot fuel through the pilot block.

9. The fuel injector of claim 7, wherein the primary perforated plate includes a second perforation that is smaller than the first perforation and configured to change the combustor oscillation mode and amplitude.

10. The fuel injector of claim 7, wherein the second primary fuel passage outlet is sized to change the combustor oscillation mode and amplitude.

11. The fuel injector of claim 7, wherein the primary fuel outlets have a first primary fuel outlet disposed closer to injector body face than the remaining primary fuel outlets, the first primary fuel outlet having a first primary fuel outlet space that is a distance between the injector body face and the first primary fuel outlet, the first primary fuel outlet space is sized to change the combustor oscillation mode and amplitude.

12. The fuel injector of claim 7, wherein the primary fuel outlets are spaced apart from each other at a distance of a primary fuel outlet space, the primary fuel outlet space is sized to change the combustor oscillation mode and amplitude.

13. The fuel injector of claim 12, wherein the primary fuel outlet space is less than the first primary fuel outlet space.

14. A fuel injector for a gas turbine engine, comprising:

a flange;

a primary fuel fitting for receiving a main fuel, affixed to the flange;

a distribution block extending from the flange, the distribution block defining a fuel inlet passage extending into the distribution block, the fuel inlet passage in flow communication the primary fuel fitting;

a first primary tube extending from the distribution block;

a secondary tube extending from the distribution block and in flow communication with the fuel inlet passage;

a pilot fuel fitting for receiving a pilot fuel;

a tube stem extending from the aft side of the flange, through the flange and distribution block, towards the forward direction, and including a pilot fuel tube disposed within the tube stem, having a pilot fuel passage formed by the pilot fuel tube and in flow communication with the pilot fuel fitting; and an injector head including an injector body having a first portion, partially disposed adjacent the tube stem, extending outward from the tube stem, having a first portion hollow cavity, a second portion disposed adjacent the first portion, extending towards the forward direction, having a second portion hollow cavity adjacent the first portion hollow cavity, and having an injector body face disposed at an aft end of the second portion, opposite the first portion, a body primary fuel passage extending through the second portion, a second primary fuel passage extending through the second portion, and having a second primary fuel passage outlet disposed at the injector body face, and a primary fuel gallery comprising the first portion hollow cavity and the second portion hollow cavity, in flow communication with the second primary fuel passage, the body primary fuel passage, and the secondary tube, a primary perforated plate disposed within the primary fuel gallery, and having a first perforation, and an outer premix barrel including a vane portion adjacent the injector body face, wherein the secondary fuel outlet of the second primary fuel passage is located between adjacent vane portions, and the vane portion including a vane primary fuel passage, aligned with the body primary fuel passage and extending into the vane portion, in flow communication with the body primary fuel passage, and primary fuel outlets extending from the vane primary fuel passage, each of primary fuel outlets extending through the vane portion.

15. The fuel injector of claim 14, the fuel injector further comprising a pilot distributor adjacent to the first portion and the tube stem, disposed radially inward of the second portion with respect to the assembly axis, and having a pilot distributor passage extending through the pilot distributor, a pilot fuel gallery formed by the pilot distributor, the tube stem, and the first portion, in flow communication with the pilot distributor passage and the pilot fuel passage, and a center body assembly located radially inward of the injector body with respect to the assembly axis, and including a center body located radially inward of the second portion with respect to the assembly axis, disposed downstream of the tube stem, and including a center body base end disposed adjacent the first portion base end, a center body tip end opposite to the center body base end, a center body middle portion extending between the center body base end and the center body tip end, and a center body pilot fuel passage defined by the center body base end, the center body middle portion, the center body tip end, and the pilot distributor, in flow communication with the pilot distributor passage, a pilot block located adjacent the center body tip end, located radially inward from the outer premix barrel, and having a pilot block pilot fuel passage in flow communication with and extending from the center body pilot fuel passage through the pilot block, and a center body tip portion disposed adjacent the pilot block, extending from the pilot block in the forward direction, and having a pilot premix passage formed by the hollow cylindrical shape of the center body tip portion and in flow communication with the pilot block pilot fuel passage, and a tip air passage extending through the center body tip and in flow communication with the pilot premix passage.

16. The fuel injector of claim 15, wherein the pilot distributor passage is sized to change the combustor oscillation mode and amplitude.

17. The fuel injector of claim 15, wherein the pilot distributor is disposed between the tube stem and the center body middle portion.

18. The fuel injector of claim 14, wherein the primary perforated plate is partially disposed between the secondary tube and the second portion.

* * * * *